US007967157B2

(12) United States Patent
Bilotto

(10) Patent No.: US 7,967,157 B2
(45) Date of Patent: Jun. 28, 2011

(54) STILLAGE FOR TRANSPORT AND DISPLAY OF ARTICLES

(76) Inventor: Francis Bilotto, Heatherton (AU)

( * ) Notice: Subject to any disclaimer, the term of this patent is extended or adjusted under 35 U.S.C. 154(b) by 149 days.

(21) Appl. No.: 12/380,480

(22) Filed: Feb. 27, 2009

(65) Prior Publication Data

US 2009/0272705 A1 Nov. 5, 2009

(51) Int. Cl.
*A47B 43/00* (2006.01)

(52) U.S. Cl. ..... 211/194; 211/182

(58) Field of Classification Search ..... 211/126.2, 211/188, 194, 85.17, 59.2, 182; 108/53.1, 108/53.5, 55.1, 56.1; 312/111
See application file for complete search history.

(56) References Cited

U.S. PATENT DOCUMENTS 2,469,151 A * 5/1949 Bremer ..... 269/16
2,677,470 A * 5/1954 Catalano ..... 108/62
2,699,911 A * 1/1955 Chase et al. ..... 108/53.5
3,664,273 A * 5/1972 Howe ..... 108/53.1
3,946,876 A * 3/1976 Jay ..... 211/60.1
4,119,045 A * 10/1978 Michelotti ..... 108/156
4,982,849 A * 1/1991 Flum et al. ..... 211/59.2
5,348,149 A * 9/1994 McCarthy ..... 206/326
5,685,238 A * 11/1997 Chambers ..... 108/193
6,135,299 A * 10/2000 Burgess ..... 211/194
6,279,763 B1 * 8/2001 Bush ..... 211/195
6,325,224 B1 * 12/2001 Brown ..... 211/194

* cited by examiner

*Primary Examiner* — Korie Chan
(74) *Attorney, Agent, or Firm* — The Halvorson Law Firm

(57) ABSTRACT

An array of stillages mounted on top of each other or one stillage is able to be disposed at an angle to another. The advantage of this arrangement is that space between adjacent stillages in an array can be adjusted to hold a range of different sized articles during transport. A further advantage is that once the articles have reached their destination, the array of stillages can be further adjusted to angle one platform relative to another. In this way articles, which have been transported can then be displayed professionally by reconfiguring the array of stillages after reaching a destination.

6 Claims, 9 Drawing Sheets

FIG. 3A
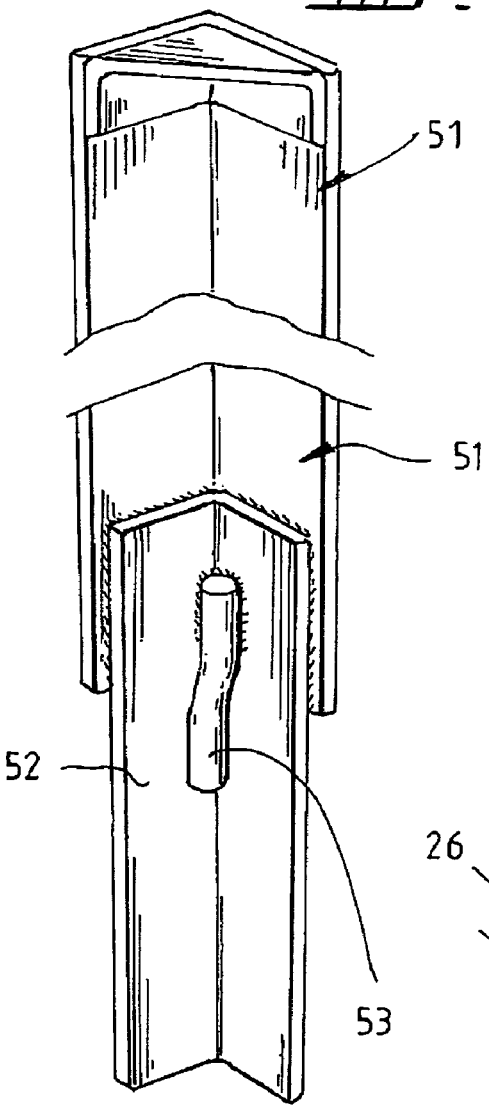
FIG. 3B
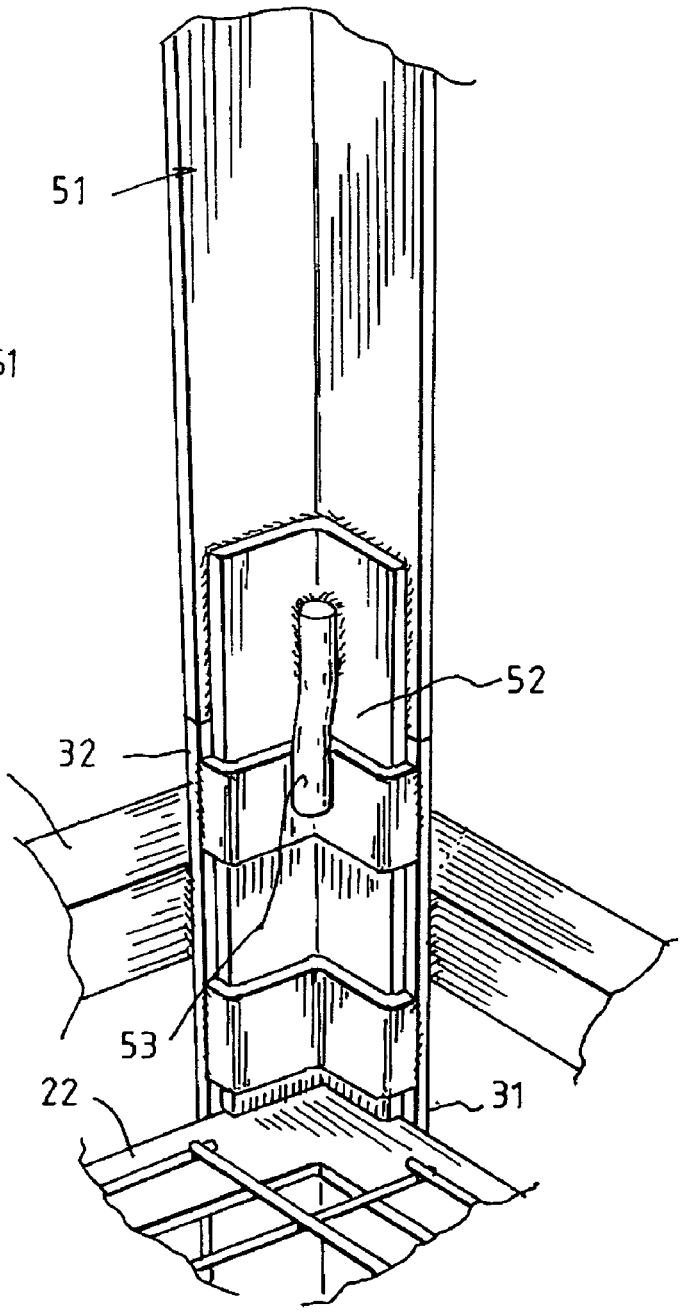
FIG. 4A

STILLAGE FOR TRANSPORT AND DISPLAY OF ARTICLES

This application claims priority based upon International Application PCT/AU2007/001283 filed on 31 Aug. 2007 which is a continuation of Australian Provisional patent application no. 2006904750 filed on 31 Aug. 2006

FIELD OF THE INVENTION

The present invention relates to a device for transporting and displaying articles. In particular, the present invention relates to an improved stillage for efficient transporting of articles and use as a display means for displaying articles.

BACKGROUND OF THE INVENTION

Stillages are generally used for transportation and storage of items that are not capable of being stacked for transportation upon a pallet. Such items include but are not limited to plants in pots. It is primarily for use in transporting awkward and movable items and therefore a stillage for practical purposes includes side panels for enclosing items to be stored on a base section.

Stillages generally comprise a framework having a base with upwardly extending support legs fixably located at corner regions of the base and interconnected by non-displaceable cross-members. Articles to be stored or transported by the stillage, rest on the base and are located between and retained by the upwardly extending support legs and cross-members. One disadvantage of such stillages is that when the transported articles are removed, an empty stillage occupies considerable space, which is not only wasteful but proves costly when the stillages are being returned for reuse.

A further drawback of known stillages is that there is generally a practical limitation on the number of stillages that can be transported. Also different sized articles are not easily accommodated by known stillages without adversely decreasing the effective use of transport space.

It is an object of the present invention to address and ameliorate at least one of the above mentioned disadvantages or at least provide a useful alternative.

It is a further object of the present invention to provide a stillage which more efficiently utilizes transport space and which can accommodate a range of different sized articles.

It is an even further object of the invention to provide a transport means which can also be used to display articles post-transport.

SUMMARY OF THE INVENTION

In accordance with the invention there is provided an improved stackable stillage for transport and display of articles including: a base frame including a generally planar platform for receiving an article or plurality of articles thereon; a series of spaced apart support legs, each having a foot, connected to the base frame for supporting the platform of the base frame; a side frame mounted on the base frame or the support legs and forming a retaining wall about at least a portion of the platform for retaining article(s) thereon; and a connecting head mounted on the base frame or the support legs and extending above the side frame and able to engage the corresponding foot of second stillage in a stackable array.

The connecting head can be shaped to receive a height adjustment element adapted to engage the foot of a second stillage in a stackable array, wherein the distance and angle between one platform of one stillage and a platform of an adjacent stillage in a stack of stillages can be adjusted to provide accommodation for a range of different sized articles in the stack and to angle at least one of the stillages for display of articles in the stillages following transport of said stillages.

The present invention provides an improved stillage system compared to prior art stillages. By providing a system that can be adjusted in height, more efficient use of transport space is achieved. In addition to the improved use of transport space, the system of the present invention can be adjusted following transport and delivery to provide a display structure in which the articles transported can be presented for display and sale.

The improved system can accommodate a range of different sized articles within a stack or array of stillages, hence articles of varying size can be easily transported. The stillage system according to the invention provides stable stacking of one stillage on top of another, and the inclusion of a height adjustment element allows a transport operator to adjust the distance between one platform and another of neighbouring stillages to allow suitable space between adjacent platforms for transporting different sized articles within a stack.

The base frame can include a central open mesh structure surrounded by a peripheral frame edge. Generally, the base frame has a square or rectangular geometry. Preferably the support legs are mounted at corner portions of the base frame on the peripheral frame edge portion. The support legs are preferably 'L-shaped' in cross section.

The support legs of the stillage in accordance with the present invention can include a foot for stabilising the stillage. The foot(s) can include a recessed portion for receiving an upper portion of the height adjustment element of an adjacent stillage in an array. The recessed portion of the each foot allows stable stacking of one stillage on top of another. The foot portions can be a bulbous structure to help stabilise the platform.

The support leg can include a leg for raising the base frame above the foot. The leg of the support legs can further include a sleeve member for receiving the height adjustment element. Preferably the sleeve can be a pair of spaced apart sleeve members, which receive the height adjustment element in sliding engagement.

The height adjustment element can include a releasable arm member adapted to slidably locate within the sleeve of the support leg. The arm member can be adjusted in length to selectively alter the distance between a neighbouring stillage. This allows the distance between one base frame and an adjacent base frame in a stack of stillages to be adjusted to accommodate different sized articles. The arm member preferably has a cross sectional configuration which substantially corresponds to the cross section of the support leg. The arm member can include a tongue whereby the tongue engages one of the sleeve members in sliding arrangement.

In the system of the invention, the height adjustment element allows adjustment of space between a platform relative to its neighbouring platform to accommodate different sized articles within an array of stillages. Further, the height adjustment element(s) can be separately adjusted to angularly position the platform of one stillage relative to its neighbouring stillage. One advantage of this adjustability is that the stillages can be used as a means for displaying articles once they have been transported.

In one aspect of the present invention the panel or panels forming a retaining wall can be mounted to legs of at least two support legs spaced from the base frame in offset relation to the peripheral frame edge. The retaining wall can include upright support legs, wherein the upright support legs interconnect the peripheral frame edge and the panel(s), in spaced apart relation to the peripheral frame edge.

In a related aspect of the present invention there is provided a stillage assembly system comprising at least a first and second stillage being adjustably mounted in a stacking condition, the at least first and second stillage including: a base frame including a platform for receiving an article or plurality of articles thereon, and a peripheral frame edge, wherein the base frame is supported by support legs such that the platform is held off the ground; a plurality of support legs, the support legs having a leg ending in a foot portion wherein the peripheral frame edge of the base frame is mounted to the legs of the support legs, at least one side panel mounted to the leg, wherein the side panel is spaced from the base frame and being at least in part co-extensive with the platform to form a retaining wall for the article(s); adjustable legs and wherein the leg members include a foot for stabilising the stillage system during transport and receiving leg members of an adjacent stillage; and wherein in a stacked condition the leg members can be adjusted to alter the distance between the platform of the at least first and second stillages to accommodate a range of different sized articles and wherein one stillage can be angled relative to another so that articles resting on at least one platform can be presented for display.

In accordance with the present invention, a stillage can be a square or rectangular shape including four adjustable leg members at each corner position. A stillage in accordance with the present invention can include vertical cross members linking the base frame and the side panel to improve the strength of a stillage. The base frame can include a central mesh portion surrounded by a peripheral edge. Corner sections of the peripheral edge can be mounted to corresponding leg members.

In accordance with a further related aspect of the invention there is provided an improved stillage for transport and display of articles including: a base frame including a generally planar platform for receiving an article or plurality of articles thereon; a series of spaced apart support legs mounted to the base frame for supporting the platform of the base frame off the ground; a panel or panels interconnecting the support legs, wherein the panel or panels form a retaining wall about at least a portion of the platform for retaining article(s) thereon; and a height adjustment system attached to top or bottom portions of the support legs, wherein the height adjustment system allows relative adjustment of height and angular disposition between the platform of the stillage and a neighbouring platform.

The height adjustment system can include an interchangeable arm member attachable to the support leg(s) to adjust the distance between one stillage and a neighbouring stillage and thus provide accommodation for a range of different sized articles in a stack. The height adjustment element(s) can also be altered to allow angular positioning of the stillage. This allows display of articles following transport.

BRIEF DESCRIPTION OF THE DRAWINGS

In order that the invention is more readily understood an embodiment of the invention will be described by way of illustration only with reference to the drawings wherein:

FIG. 3A shows a perspective view of a detail of the top of the extended height adjustment elements of a single stillage of FIG. 2A;

FIG. 3B shows a perspective view of a detail of the bottom of the extended height adjustment elements of a single stillage of FIG. 2A;

FIG. 4A shows a close-up perspective inner view of interengagement between a leg of a support leg and an adjustment element of the stillage system of FIG. 1A;

DETAILED DESCRIPTION OF THE PREFERRED EMBODIMENTS WITH RESPECT TO THE ACCOMPANYING DRAWINGS

Figure 1A:
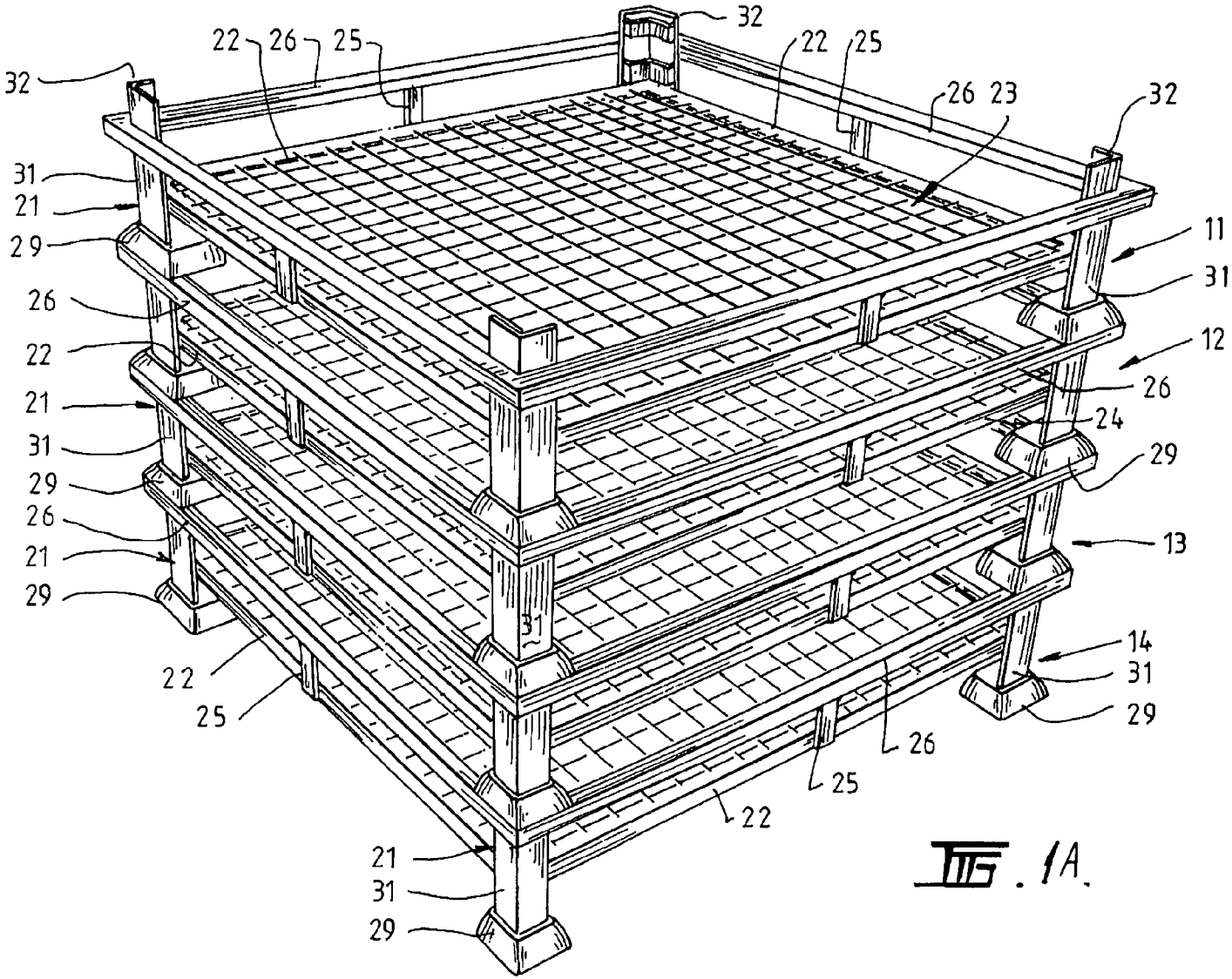
FIG. 1A shows a front perspective view of a stackable stillage system in accordance with an embodiment of the present invention.
Figure 1B:
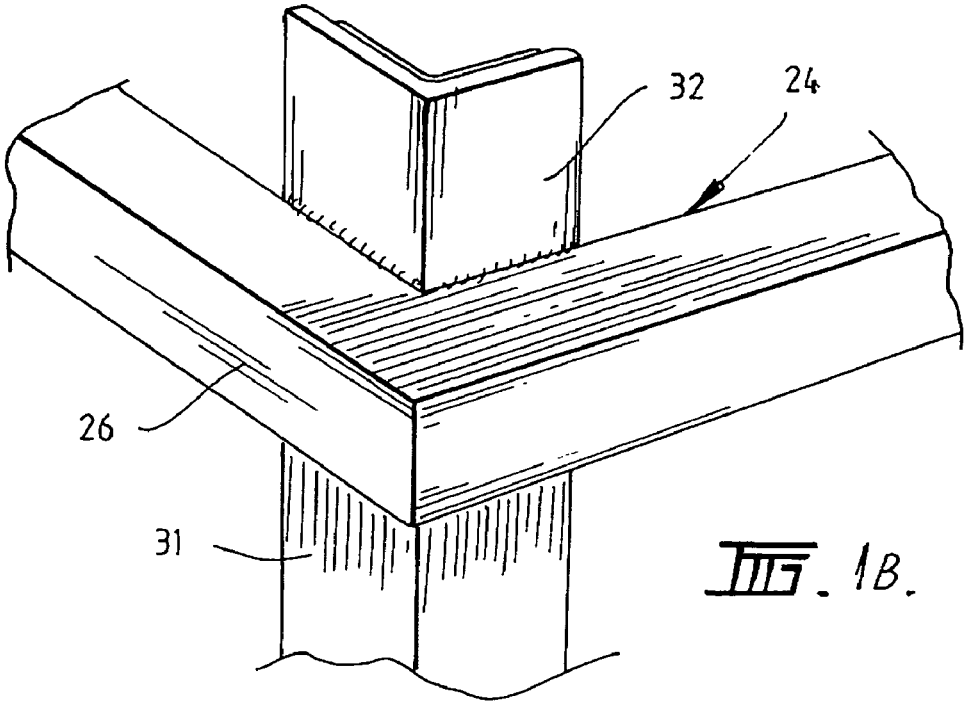
FIG. 1B shows a perspective view of a detail of the top connector of a single stillage of the stillage system of FIG. 1A.
Figure 1C:
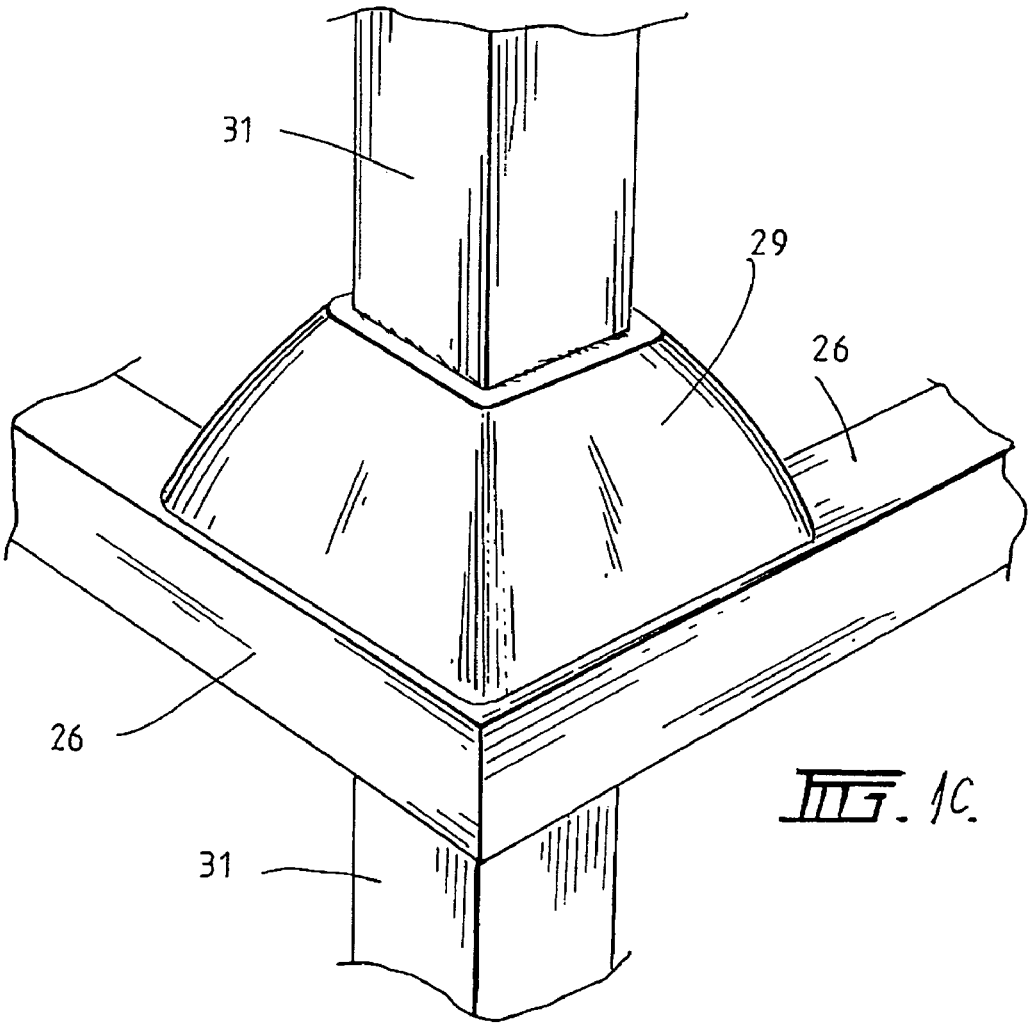
FIG. 1C shows a perspective view of a detail of the bottom connector of a single stillage of the stillage system of FIG. 1A.

Referring to the drawings there is shown in FIG. 1 an improved stackable stillage system for transport and display of articles including a plurality of stillages 11, 12, 13, 14. However the substantial benefit of the system is in its use of a plurality of releasable height adjustment elements 51.

The stillages 11, 12, 13, 14 shown in FIG. 1A for transport and display of articles include a base frame 21 of generally rectangular configuration having a planar central platform 23 comprising a wire mesh type structure. The base frame also includes a peripheral side edge 22 on which the platform is mounted.

As shown in this embodiment, the base frame 21 of the bottom stillage 14 is supported off the ground, by support legs 31 located at each corner of the rectangular base frame. The base frame 21 is further strengthened by cross-members 26 connecting between support legs 31 and forming uppermost portion of the side frame 24. Therefore the side frame 24 of the stillage includes substantially vertical members 25 extending between peripheral side edge 22 and uppermost cross-members 26.

The support legs 31 include a central portion having an upper end forming a connecting head 32 and a lower end where there is formed a bulbous foot 29, which has an internal recess (not shown). As shown in FIG. 1A, the foot 29 contacts the ground and stabilises the stillage system during transport and display of articles. Further the spacing and strength of the base frame allows ready transporting by forklift or the like.

As shown in detail in FIG. 1B the stillage includes a connecting head 32 mounted on the base frame or the support legs and extending above the side frame 24 and able to engage and be enveloped by the corresponding foot 29 of second stillage in a stackable array as shown in detail in FIG. 1A. The internal recess of the foot 29 (not shown) is shaped to stably receive the upper end of the support leg forming the connecting head 32 of a neighbouring stillage to form a stable stack of stillages.

Figure 2A:
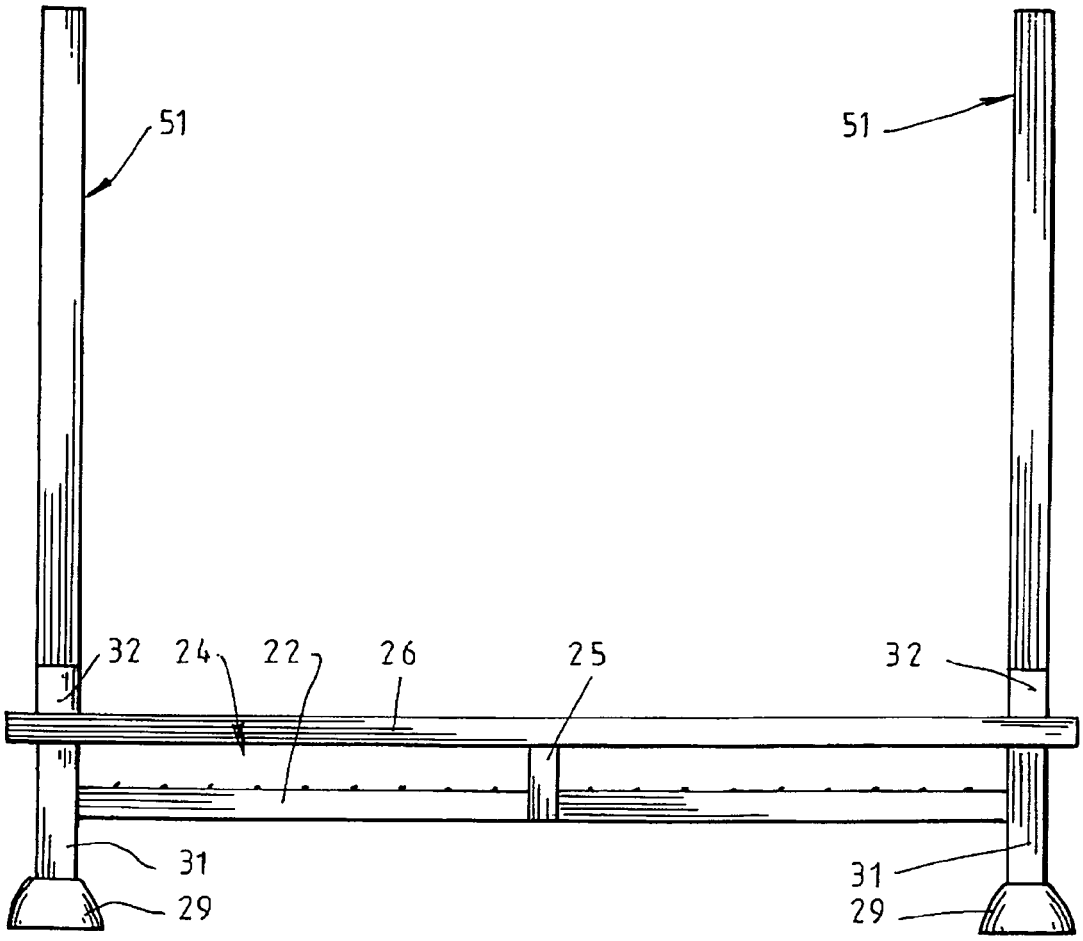
FIG. 2A shows a perspective view of single stillage having extended height adjustment elements in accordance with an embodiment of the present invention.
Figure 2B:
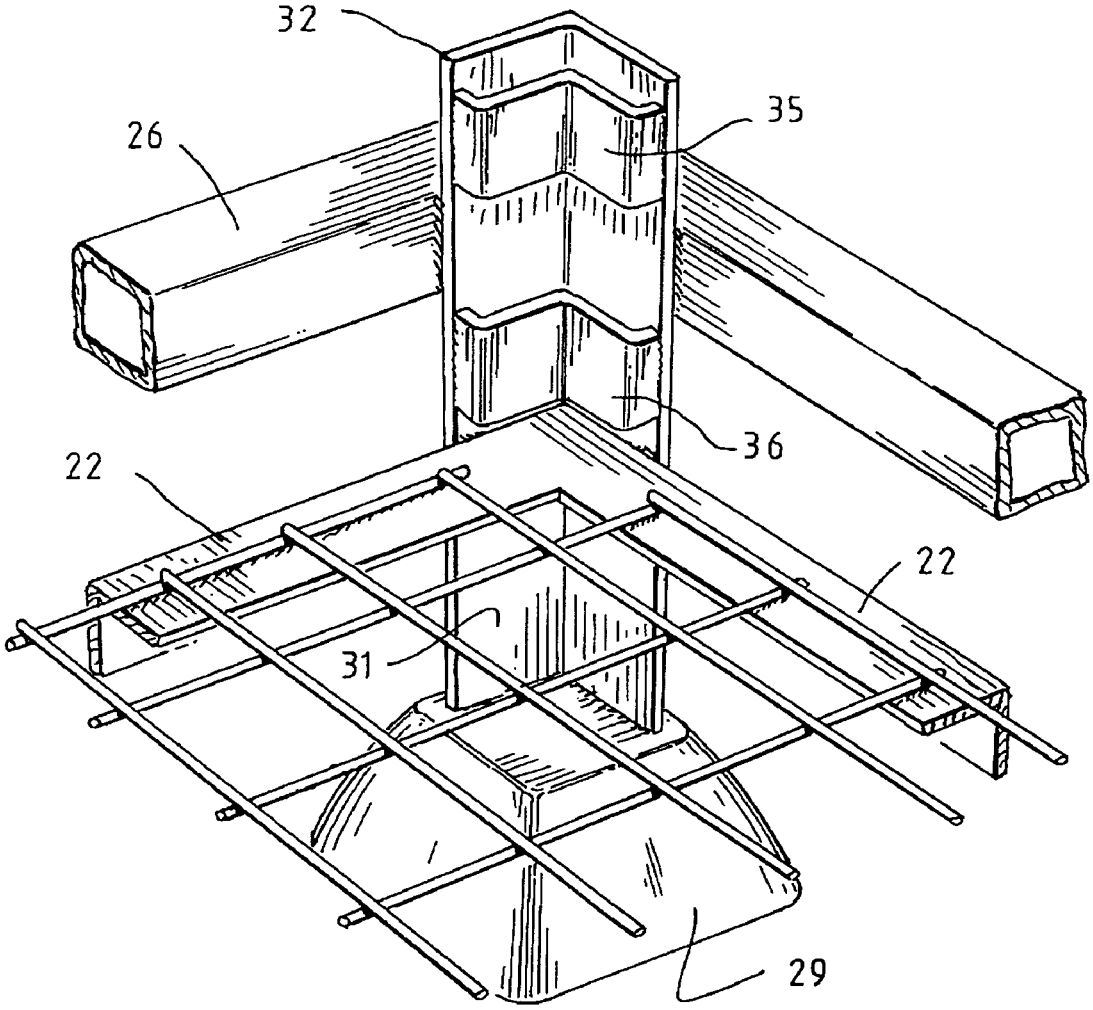
FIG. 2B shows a perspective view of a detail of the top connector of a single stillage of the stillage system of FIG. 2A.
Figure 2C:
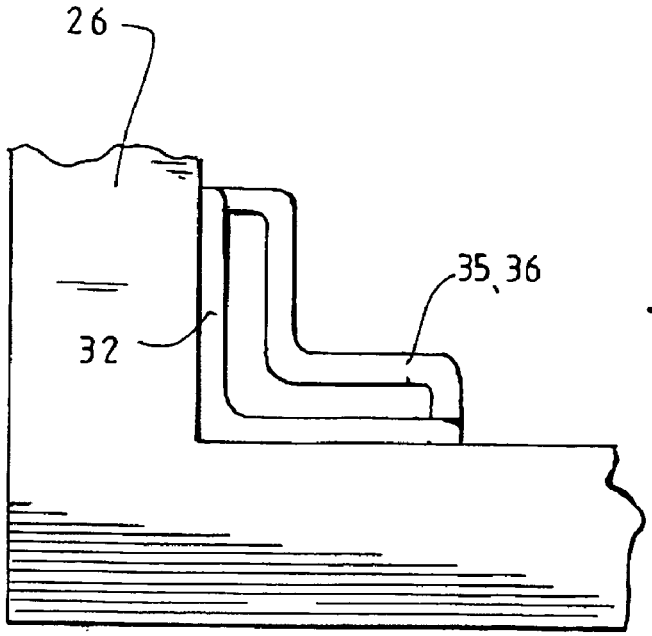
FIG. 2C shows a overhead view of a detail of the top connector of a single stillage of the stillage system of FIG. 2A.

Referring to FIGS. 2A, 2B and 2C, there is shown a closer view of upper end of the support leg 31 forming the connecting head 32 and having an 'L'-shaped cross-section. Spaced along its length are two spaced apart substantially "L"-shaped sleeve members 35, 36 forming sleeve for receiving a height adjustable element 51 in sliding relation with the support leg. Thereby each of the connecting heads 32 is shaped to receive a corresponding height adjustment element which in turn is adapted to engage the foot of a second stillage in a stackable array, wherein the distance and angle between one platform of one stillage and a platform of an adjacent stillage in a stack of stillages can be adjusted to provide accommodation for a range of different sized articles in the stack and to angle at least one of the stillages for display of articles in the stillages following transport of said stillages.

The height adjustment element 51 is shown in detail FIGS. 3A, 3B and 4A. In this embodiment the height adjustment element consists of a lower portion 52 of corresponding cross section to the openings of the sleeve member 35, 36. The height adjustment element 51 includes a tongue 53 appended to the lower portion 52 and protruding and extending towards along the height adjustment element 51 to its lowest end. In use the tongue slides into engagement around outside of the upper sleeve member 36 and therefore must be suitably spaced from the lowest end of the height adjustment element 51 to allow engagement of the lower end 52 of the height adjustment element 51 through both sleeve members 35, 36. The tongue provides dual function of precisely limiting the depth of a height adjustment element and maintaining close engagement of the L-shaped lower section and the L-shaped connecting head of the support leg for structural strength. Thereby height adjustment element 51 is stably housed within the spaced apart sleeve members 35, 36 in an abutting relation with the support leg.

Figure 4B:
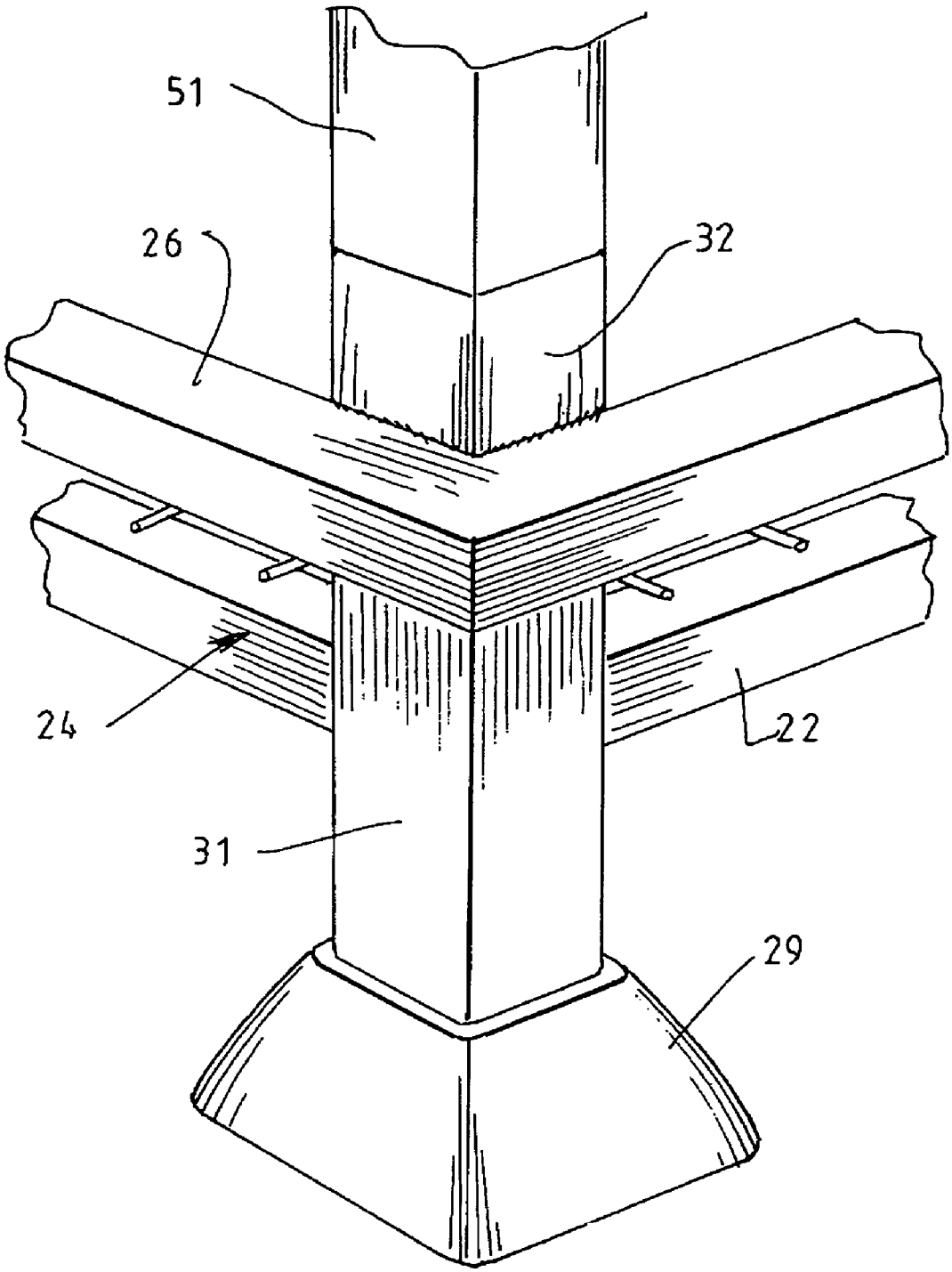
FIG. 4B shows a close-up perspective outer view of interengagement between a leg of a support leg and an adjustment element of the stillage system of FIG. 1A.
Figure 4C:
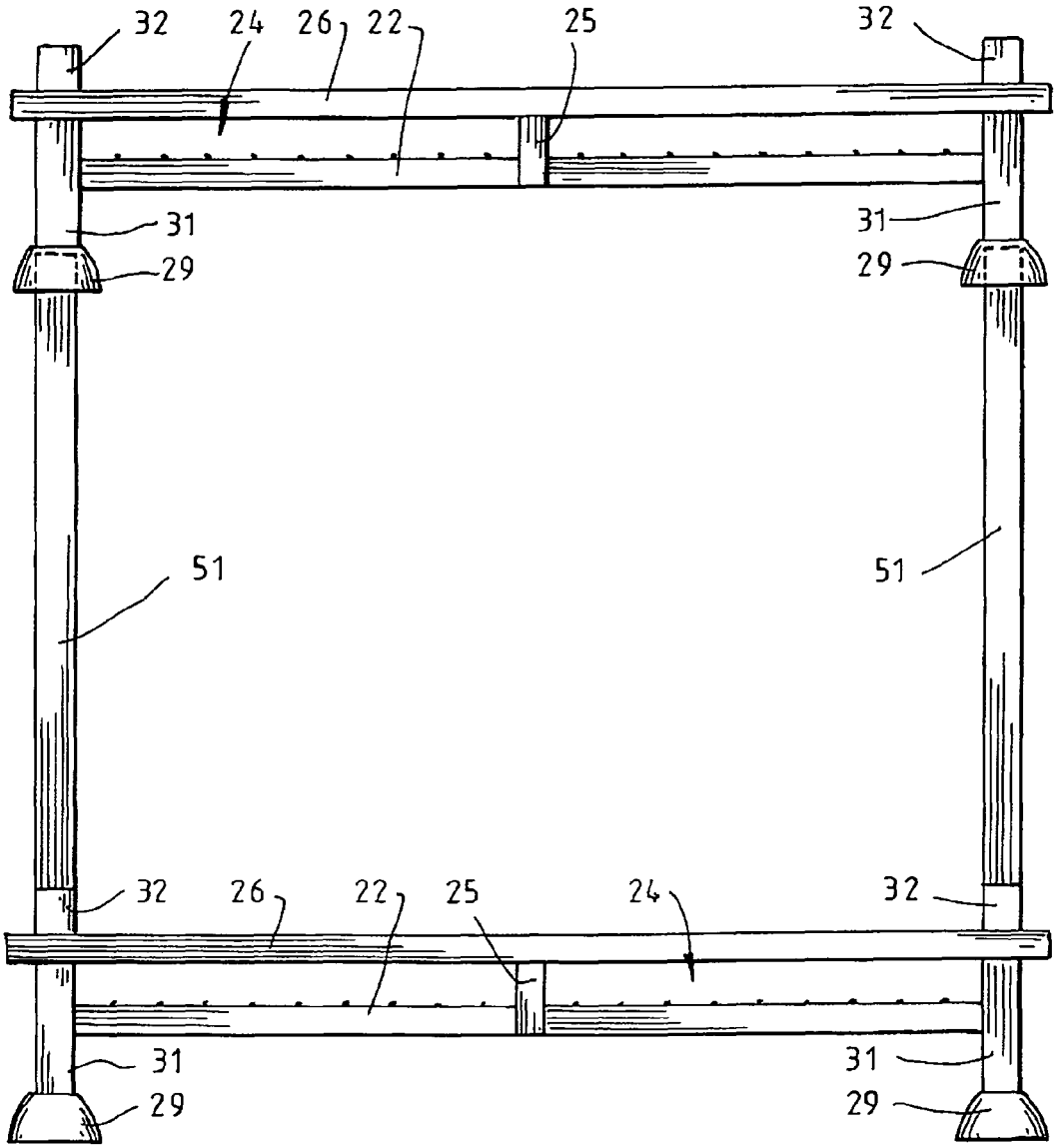
FIG. 4C shows a perspective view of interengagement between two stacked stillages by adjustment elements of the stillage system of FIG. 1A.

As shown in FIGS. 4B, and 4C the adjustment elements 51 may be selectively chosen with particular length to space a stillage above a second stillage to allow holding of articles of height requiring such spacing. However for transport the height adjustment elements 51 can be removed for more compact transport after use.

Figure 5A:
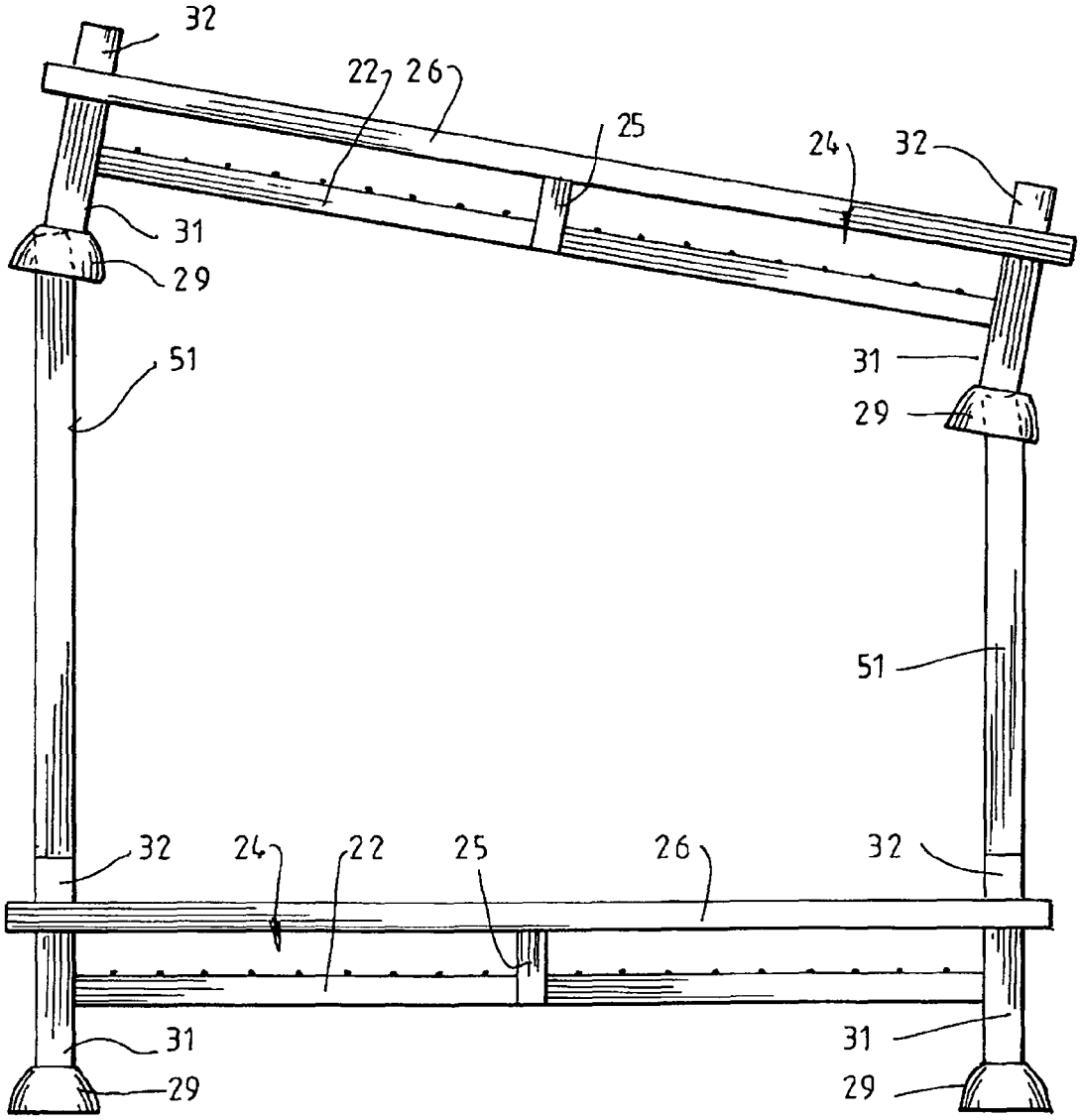
FIG. 5A shows a perspective view of interengagement between two stacked stillages by a first and second different length sets of adjustment elements of the stillage system of FIG. 1A.
Figure 5B:
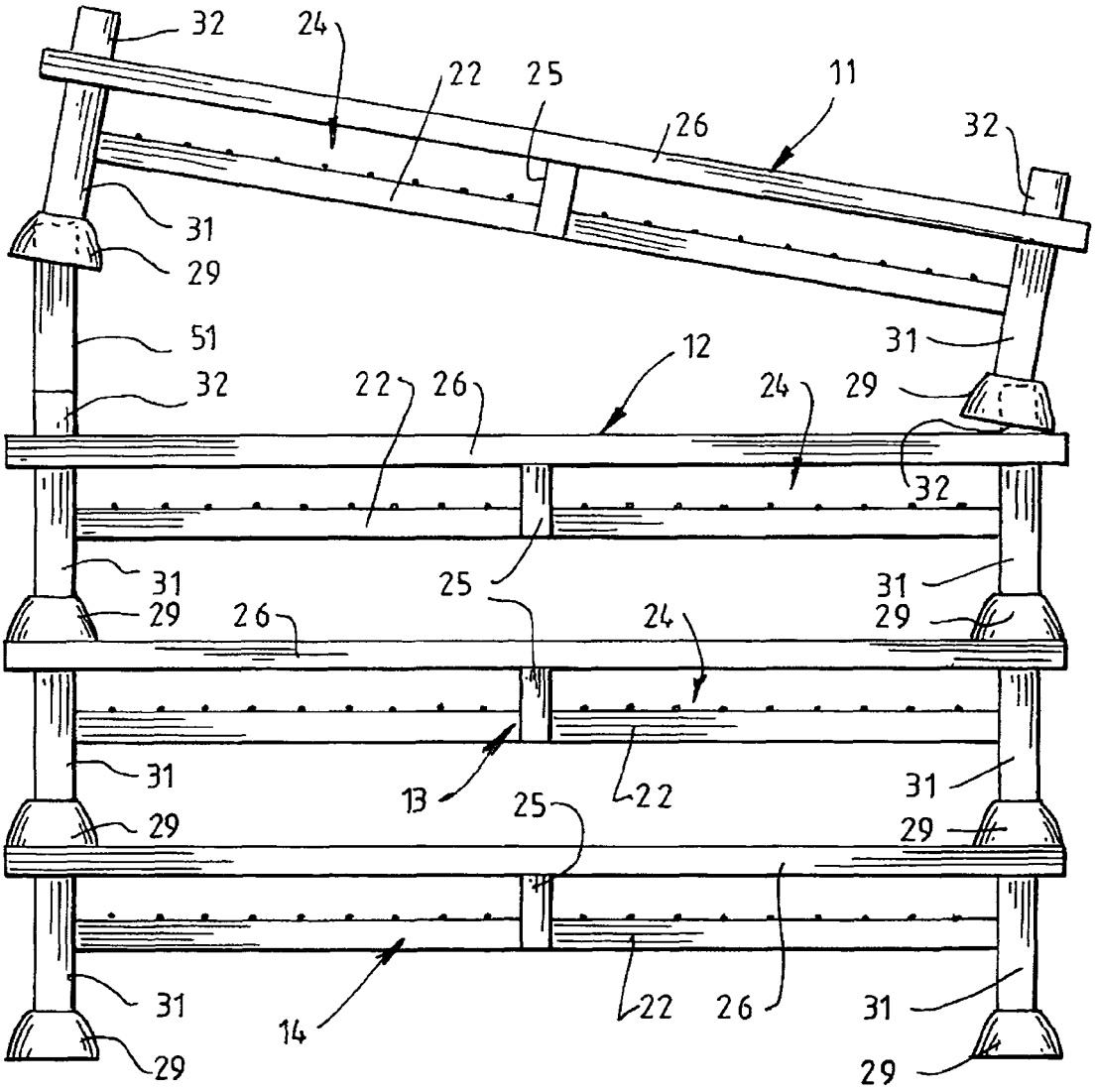
FIG. 5B shows a perspective view of interengagement between two stacked stillages by a third different length sets of adjustment elements of the stillage system of FIG. 1A.

However as shown in FIGS. 5A and 5B a further substantial advantage is achieved by substituting with a separate height adjustment elements of differing length.

The height adjustment element has a shaped cross section which is received by a second stillage in a stackable array, wherein the distance and angle between one platform and its neighbouring platform in a stack of stillages can be adjusted to provide accommodation for a range of different sized articles in the stack and display said articles.

Referring to FIGS. 4 and 5, there is illustrated an array of stillages mounted on top of each other or one stillage is able to be disposed at an angle to another. The advantage of this arrangement is that space between adjacent stillages in an array can be adjusted to hold a range of different sized articles during transport. A further advantage is that once the articles have reached their destination, the array of stillages can be further adjusted to angle one platform relative to another. In this way articles, which have been transported can then be displayed professionally by reconfiguring the array of stillages after reaching a destination.

It can be seen by particularly FIGS. 5A, and 5B that the shape of the foot of each support leg includes a bulbous structure with a recessed under portion is an important feature that allows stable stacking of one stillage on top of another but particularly allows angular stacking relative to each other. It is the recessed under portion having outwardly expanding cavity to the open bottom for receiving an upper portion of the height adjustment element of an adjacent stillage in an array that tends it to a central position and thereby a stable configuration regardless of the different heights. Clearly practical limitations apply due to tipping of the articles in the stillage. However within such practical limitations this configuration of engagement provides a stable system.

It should be understood that the above description is of a preferred embodiment and included as illustration only. It is not limiting of the invention. Clearly variations of the improved stackable stillage system would be understood by a person skilled in the art without any inventiveness and such variations are included within the scope of this invention as defined in the following claims.

The invention claimed is:

1. An improved stackable stillage system for transport of articles of different sizes from an originating point to a destination point, and display of said articles at the destination point, the system including:

at least a first and second stillage in a stackable array, and a plurality of releasable height adjustment elements of various lengths, wherein the at least first and second stillage including:

a base frame including a generally planar platform for receiving an article or plurality of articles thereon;

a series of spaced apart support legs, each having a foot, said support legs connected to the base frame for supporting the platform of the base frame, wherein the support legs include a sleeve member for releasably receiving one of the height adjustment elements, and wherein the foot of each support leg includes a bulbous structure with a recessed under portion having an outwardly expanding cavity to the open bottom;

a side frame mounted on the base frame or the support legs and forming a retaining wall about at least a portion of the platform for retaining article(s) thereon;

the height adjustment element has a bottom portion complementary in shape to the sleeve and thereby adapted to slidably and releasably locate within the sleeve of the support leg, and a top portion including a connecting head extending above the side frame, wherein the connecting head is shaped to receive the under portion of the foot of the second stillage thereabove in engaged relation in a stackable condition;

wherein the distance between the platforms of the at least first and second stillage in a stackable condition is adjustable by the height adjustment elements to allow accommodation for a range of different sized articles between the elements platforms of the at least first and second stillages during transport; and wherein the height adjustment elements are further separately adjustable by selecting the different lengths of height adjustment elements to allow angular positioning of the second platform relative to the first platform so that articles can be displayed on the angled platform of the second stillage for display at the destination point.

2. An improved stackable stillage system according to claim 1 wherein the sleeve is a pair of spaced apart sleeve members, which receive the height adjustment element in sliding engagement.

3. An improved stackable stillage system according to claim 1 wherein the height adjustment element includes a tongue whereby the tongue engages one of the sleeve members in sliding arrangement.

4. An improved stackable stillage system according to claim 1 wherein the height adjustment element(s) are/is selectively adjustable to allow adjustment of space between the at least first and second platforms to accommodate different sized articles within an array of stillages, and allow angular positioning of one platform relative to another for display of articles in a stackable array.

5. An improved stackable stillage system according to claim 1 wherein the height adjustment element(s) is/are separately adjusted to angularly position the platform of the second stillage relative to the first stillage such that the stillages can be used as a means for displaying articles once they have been transported to the destination point.

6. A stillage assembly system for transport of articles of different sizes from an originating point to a destination point, and display of said articles at the destination point, the system comprising at least a first and second stillage in a stackable array, and a plurality of releasable height adjustment elements of various lengths, wherein the at least first and second stillage including:

a base frame including a platform for receiving an article or plurality of articles thereon, and a peripheral frame edge;

a plurality of support legs wherein the base frame is supported by the plurality of support legs such that the platform is held off the ground, the support legs having a leg ending in a foot portion wherein the peripheral frame edge of the base frame is mounted to the legs of the support legs, and wherein the support legs include a sleeve for releasably receiving one of the height adjustable elements;

wherein the foot of each support leg includes a bulbous structure with a recessed under portion having an outwardly expanding cavity to the open bottom;

at least one side panel mounted to the support legs, wherein the side panel is above the base frame and being at least in part co-extensive with the platform to form a retaining wall for the article(s) stored on the base frame;

the height adjustable elements having a bottom portion complementary in shape to the sleeve and thereby adapted to slidably and releasably locate within the sleeve of the support leg, and a top portion forming a connecting head so as to engage the recessed under portion of the foot of the second stillage in a stackable condition;

wherein in a transport condition the height adjustable elements are adjustable to alter the distance between the respective platforms of the at least first and second stillages to accommodate a range of different sized articles; and wherein in a display condition the platform of the second stillage is angled relative to the platform of the first stillage by separately by selecting the different lengths of height adjustment elements for adjusting the height adjustable elements so that the articles can be presented for display on the angled platform of the second stillage at the destination point.

* * * * *